US007781988B2

(12) United States Patent
Tamegai et al.

(10) Patent No.: US 7,781,988 B2
(45) **Date of Patent: *Aug. 24, 2010**

(54) DC/DC CONVERTER

(75) Inventors: Yoichi Tamegai, Kyoto (JP); Isao Yamamoto, Kyoto (JP)

(73) Assignee: Rohm Co., Ltd. (JP)

( * ) Notice: Subject to any disclaimer, the term of this patent is extended or adjusted under 35 U.S.C. 154(b) by 214 days.

This patent is subject to a terminal disclaimer.

(21) Appl. No.: 12/062,756

(22) Filed: Apr. 4, 2008

(65) Prior Publication Data

US 2009/0096389 A1 Apr. 16, 2009

Related U.S. Application Data

(63) Continuation of application No. 11/635,423, filed on Dec. 7, 2006, now Pat. No. 7,368,884.

(30) Foreign Application Priority Data

Dec. 9, 2005 (JP) ..... 2005-356071

(51) Int. Cl.
*H05B 37/02* (2006.01)

(52) U.S. Cl. ..... 315/307; 315/219; 315/308

(58) Field of Classification Search ..... 315/209 R, 315/212, 246, 254, 274, 287, 291, 297, 307, 315/308, 362, 219, 224–225
See application file for complete search history.

(56) References Cited

U.S. PATENT DOCUMENTS 6,445,141 B1 9/2002 Kastner et al.
6,885,159 B2 * 4/2005 Watanabe ..... 315/291
6,946,807 B2 9/2005 Okamoto et al.
7,271,544 B2 * 9/2007 Ichikawa et al. ..... 315/209 R
7,411,360 B2 * 8/2008 Henry ..... 315/307
7,414,371 B1 * 8/2008 Choi et al. ..... 315/291
7,557,517 B2 * 7/2009 Jin ..... 315/282
2006/0028148 A1 2/2006 Ichikawa et al.
2007/0013323 A1 1/2007 De Oto

FOREIGN PATENT DOCUMENTS

JP 2004-201474 7/2004
JP 2005-073483 3/2005

* cited by examiner

*Primary Examiner*—Douglas W Owens
*Assistant Examiner*—Tung X Le
(74) *Attorney, Agent, or Firm*—Cantor Colburn LLP

(57) ABSTRACT

A control circuit of a DC/DC converter is provided for supplying a driving voltage to a light emitting element. A hysteresis comparator compares a detection voltage that corresponds to the output voltage of the DC/DC converter with two threshold voltages. If the detection voltage is smaller than the lower threshold voltage, the hysteresis comparator outputs a comparison signal at the low level. Otherwise, the comparison signal is set to the high level. The switching control unit uses the comparison signal as a reference. The switching control unit instructs the switching transistor of the DC/DC converter to perform the switching operation during a period when the comparison signal is at the low level. Otherwise, the switching operation is suspended. The control circuit inhibits light emission of the light emitting element during a period when the comparison signal is at the low level. Otherwise, the control circuit permits the light emission.

12 Claims, 4 Drawing Sheets

DC/DC CONVERTER

CROSS REFERENCE TO RELATED APPLICATIONS

This application is a continuation application of the U.S. patent application Ser. No. 11/635,423 filed Dec. 7, 2006, the contents of which are incorporated by reference herein in their entirety, and priority to which is claimed under 35 U.S.C. §120. The Ser. No. 11/635,423 application claimed the benefit of the date of the earlier filed Japanese Patent Application No. JP 2005-356071 filed Dec. 9, 2005, priority to which is also claimed herein, and the entire contents of which are hereby incorporated by reference.

BACKGROUND OF THE INVENTION

1. Field of the Invention

The present invention relates to a DC/DC converter for supplying a driving voltage to a light emitting element.

2. Description of the Related Art

For the purpose of generating higher voltage than the input voltage, step-up switching regulators are widely used in various electronic devices. Such a step-up switching regulator includes a switching element and an inductor or a transformer. With such an arrangement, the switching element is alternately turned on and off in a time division manner so as to generate back electromotive force in the inductor or the transformer, thereby boosting the input voltage, i.e., thereby outputting voltage that has been stepped up.

With an isolated DC/DC converter employing a transformer, when a switching transistor is turned on, an electrical current flows through the primary winding of the transformer, thereby storing energy in the transformer. Then, when the switching transistor is turned off, the energy thus stored in the transformer is transferred to an output capacitor in the form of a charging current via a rectifier diode, thereby generating output voltage that has been stepped up.

For example, Patent documents 1 and 2 disclose a kind of isolated DC/DC converter, i.e., a self-exciting DC/DC converter which has a configuration that does not involve an oscillator, and which has a function in which the primary winding or the secondary winding of a transformer is monitored, and on/off control is performed for the switching transistor according to the state of the primary winding or the secondary winding of the transformer thus monitored.

[Patent Document 1]

Japanese Patent Application Laid-open No. 2004-201474

[Patent Document 1]

Japanese Patent Application Laid-open No. 2005-73483

Let us consider a case in which the aforementioned isolated DC/DC converter is used as a power supply for a flash light source for a camera. While a light emitting element such as a xenon lamp is employed as such a flash light source, there is a problem with the xenon lamp in that normal light emission by the xenon lamp requires a driving voltage higher than a predetermined voltage.

In order to solve the aforementioned problem, a control circuit of such a DC/DC converter needs to perform emission control as follows. That is to say, the control circuit monitors the driving voltage supplied to the xenon lamp. The control circuit permits light emission only in a case that the voltage thus monitored is equal to or higher than a predetermined level.

SUMMARY OF THE INVENTION

The present invention has been made in view of the aforementioned problems. Accordingly, it is a general purpose thereof to provide a DC/DC converter and a control circuit thereof for stable driving of a light emitting element.

An embodiment according to the present invention relates to a control circuit of a DC/DC converter for supplying a driving voltage to a light emitting element. The control circuit comprises: a hysteresis comparator which compares a detection voltage that corresponds to the output voltage of the DC/DC converter with two threshold voltages, and output a first-level comparison signal when the detection voltage is smaller than the lower threshold voltage, and outputs a second-level comparison signal when the detection voltage is greater than the lower threshold voltage; and a switching control unit which controls the switching operation of a switching element included in the DC/DC converter according to the comparison signal output from the hysteresis comparator as a reference signal, and instructs the switching element of the DC/DC comparator to perform switching operation during a period when the comparison signal is at the first level, and suspends the switching operation of the switching element of the DC/DC comparator during a period when the comparison signal is at the second level. With such an arrangement, light emission of the light emitting element is inhibited during a period when the comparison signal is at the first level. On the other hand, the light emission is permitted during a period when the comparison signal is at the second level.

According to such an embodiment, the switching control unit performs intermittent operation in which a charging period and a suspension period are alternately executed, according to a comparison signal which is the output of the hysteresis comparator. Here, during the charging period, the switching control unit instructs the switching element to perform switching operation so as to boost the output voltage of the DC/DC converter. On the other hand, during the suspension period, the switching control unit suspends the switching operation so as to gradually reduce the output voltage. The comparison signal is set to a second level during the suspension period in which the output voltage is reduced from the higher threshold voltage to the lower threshold voltage. On the other hand, the comparison signal is set to a first level during the charging period in which the output voltage is increased from the lower threshold voltage to the higher threshold voltage. As a result, light emission of the light emitting element is permitted only during the suspension period. That is to say, light emission of the light emitting element is inhibited during the charging period.

With such an arrangement, light emission is permitted during the suspension period. Accordingly, light is emitted in a state in which the output voltage is higher the lower threshold voltage. This ensures that the light emitting element is stably driven. Furthermore, with such an arrangement, light emission is inhibited during the charging period. This prevents the charging of the output capacitor of the DC/DC converter and the discharging of light emission from occurring at the same time, thereby reducing current consumption of the circuit.

The control circuit may further comprise a transistor in which the comparison signal output from the hysteresis comparator is input to the control terminal thereof, another terminal thereof is biased to a high potential via a pull-up resistor, and the remaining terminal thereof is grounded. With such an arrangement, a state of whether or not the light emission of the light emitting element is permitted, is output according to the potential at the one terminal of the transistor.

The switching control unit may receive a step-up instruction signal from an external circuit. Also, the switching control unit may suspend the switching operation of the switching element, and may set internal circuit blocks to the off-state during a period of receiving an instruction to suspend the step-up voltage operation. Also, the switching control unit may inhibit light emission of the light emitting element during a period when the one terminal of the transistor is set to the high level.

With such an arrangement, upon turning off the hysteresis comparator during a period when the switching control unit is instructed to suspend the step-up voltage operation, the one terminal of the control transistor is pulled up to the high level in a sure manner. This inhibits light emission over the charging period in a sure manner.

The control circuit may further comprise: a first voltage comparator for comparing the voltage that corresponds to the current flowing through the primary winding of a transformer connected externally to the control circuit with a predetermined first threshold voltage; and a second voltage comparator for comparing the voltage that corresponds to the current flowing through the secondary winding of the transformer with a predetermined second threshold voltage. With such an arrangement, on/off control is performed for the switching element according to the output signals of the first and second voltage comparators in a self-exciting manner.

The control circuit may be provided in a form integrated on a single semiconductor substrate. Examples of "circuit provided in a form integrated on a single semiconductor substrate" include an arrangement in which all the components of a circuit are formed on a single semiconductor substrate; and an arrangement in which principal components of a circuit are provided in a form integrated on a single semiconductor substrate. Such examples also include an arrangement in which a part of resistors or capacitors for adjusting the circuit constants is provided externally to the semiconductor substrate.

Another embodiment according to the present invention relates to a light emitting apparatus. The light emitting apparatus comprises: a DC/DC converter including a switching transistor which allows step-up voltage operation to be controlled by performing on/off control for the switching transistor; the aforementioned control circuit for performing on/off control for the switching transistor; a light emitting element driven by the output voltage of the DC/DC converter; and a microprocessor for controlling the light-emission state of the light emitting element. With such an arrangement, the control circuit outputs a signal, which corresponds to the comparison signal, to the microprocessor so as to control whether or not light emission of the light emitting element is permitted.

The light emitting element may comprise a xenon tube lamp. Also, the light emission state of the xenon tube lamp may be controlled by a light emission control transistor provided on a driving path for driving the xenon tube lamp.

Yet another embodiment according to the present invention relates to a battery-driven electronic device. The battery-driven electronic device comprises: an image capturing unit; and the light emitting apparatus according to one embodiment which is used as a flash when an image is captured by the image capturing unit. With such an arrangement, the light emitting apparatus boosts the battery voltage in order to drive the light emitting element.

It is to be noted that any arbitrary combination or rearrangement of the above-described structural components and so forth is effective as and encompassed by the present embodiments.

Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

Figure 1:
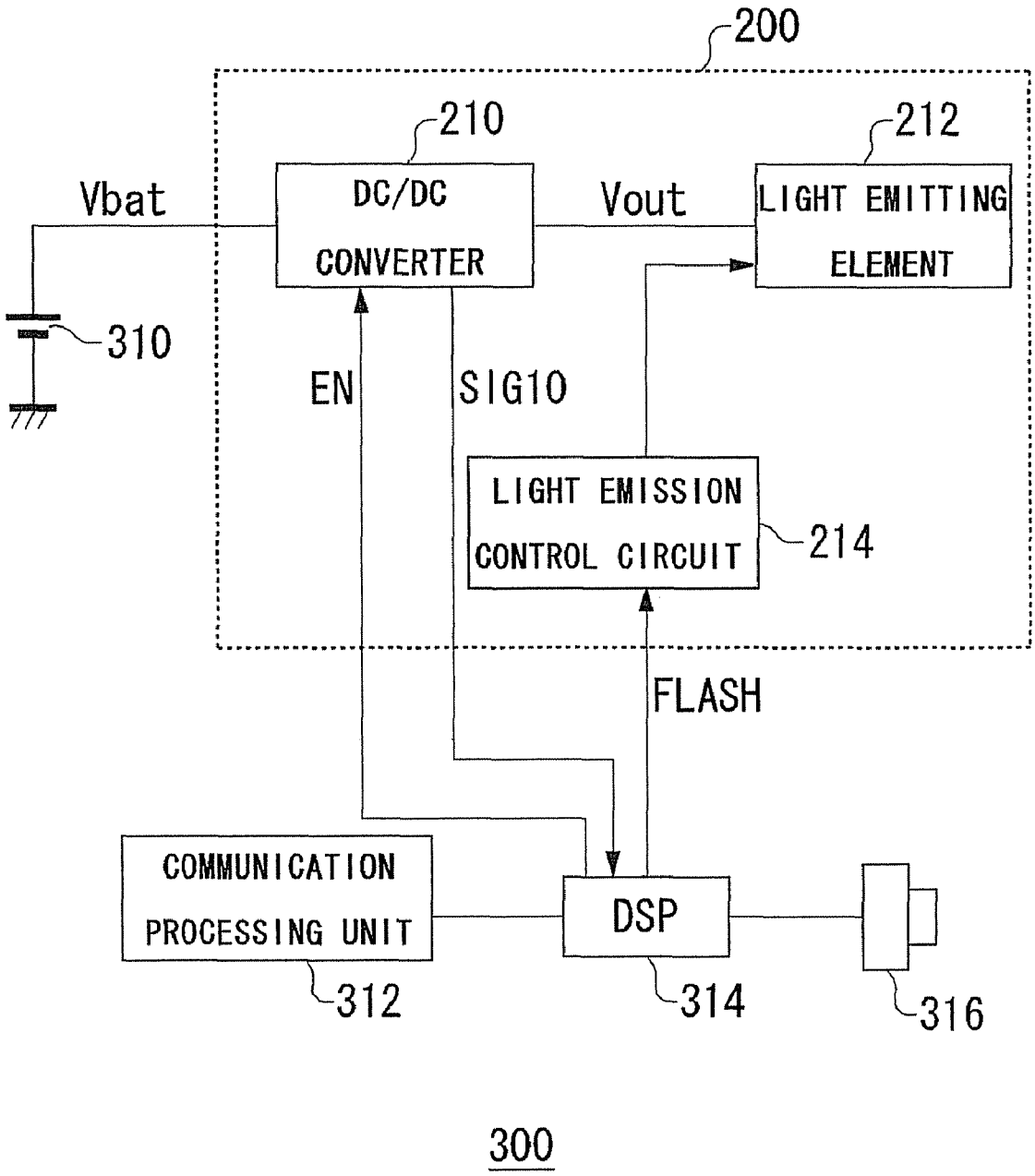
FIG. 1 is a block diagram which shows the configuration of an electronic device mounting a light emitting apparatus according to an embodiment.

FIG. 1 is a block diagram which shows a configuration of an electronic device 300 mounting a light emitting apparatus 200 according to an embodiment. The electronic device 300 is a cellular phone terminal mounting a camera including: a battery 310; a communication processing unit 312; a DSP (Digital Signal Processor) 314; an image capturing unit 316; and the light emitting apparatus 200.

The battery 310 is a lithium ion battery, for example, and is provided as a power supply for the electronic device 300. The battery 310 supplies a battery voltage of around 3 to 4 V. The DSP 314 is a block for centrally controlling the entire electronic device 300, and is connected to the communication processing unit 312, the image capturing unit 316, and the light emitting apparatus 200. The communication processing unit 312 includes an antenna, high-frequency circuit, and so forth, and is a block for communicating with a base station. The image capturing unit 316 comprises an image capturing device such as a CCD (charge Coupled Device), a CMOS sensor, or the like. The light emitting apparatus 200 is a light source used as a flash when the image capturing device 316 captures an image.

The light emitting apparatus 200 includes a DC/DC converter 210, a light emitting element 212, and a light emission control circuit 214. A xenon tube or the like is employed as the light emitting element 212. The DC/DC converter 210 is a step-up switching regulator which provides a function of boosting the battery voltage Vbat supplied from the battery 310 up to around 300 V. The battery voltage Vbat thus boosted is supplied to the light emitting element 212 as the driving voltage Vout. The light emission control circuit 214 is a circuit for controlling the timing of light emission of the light emitting apparatus 200.

The DSP 314 outputs a flash signal FLASH to the light emission control circuit 214, synchronous with the timing of the image capture performed by the user. Upon reception of the flash signal FLASH, the light emission control circuit 214 instructs the light emitting element 212 to emit light. Furthermore, the DSP 314 outputs a step-up instruction signal EN to the DC/DC converter 210. The DC/DC converter 210 performs the step-up operation during the period when the step-up instruction signal EN is set to the high level. On the other hand, during the period when the step-up instruction signal EN is set to the low level, the converter 210 suspends the step-up operation, and the internal circuit blocks are turned off, thereby providing a low power consumption standby state.

Normal light emission by the light emitting element 212 requires the supply of a sufficiently high driving voltage. In order to solve this problem, with the electronic device 300 according to the present embodiment, the DC/DC converter 210 monitors the voltage that corresponds to the output voltage Vout supplied to the light emitting element 212. Furthermore, the DC/DC converter 210 notifies the DSP 314 of whether or not light emission is permitted. The DSP 314 only outputs the flash signal FLASH to the light emission control circuit 214 in a case that the light-emission permission signal SIG10 output from the DC/DC converter 210 has been set to the low level.

Figure 2:
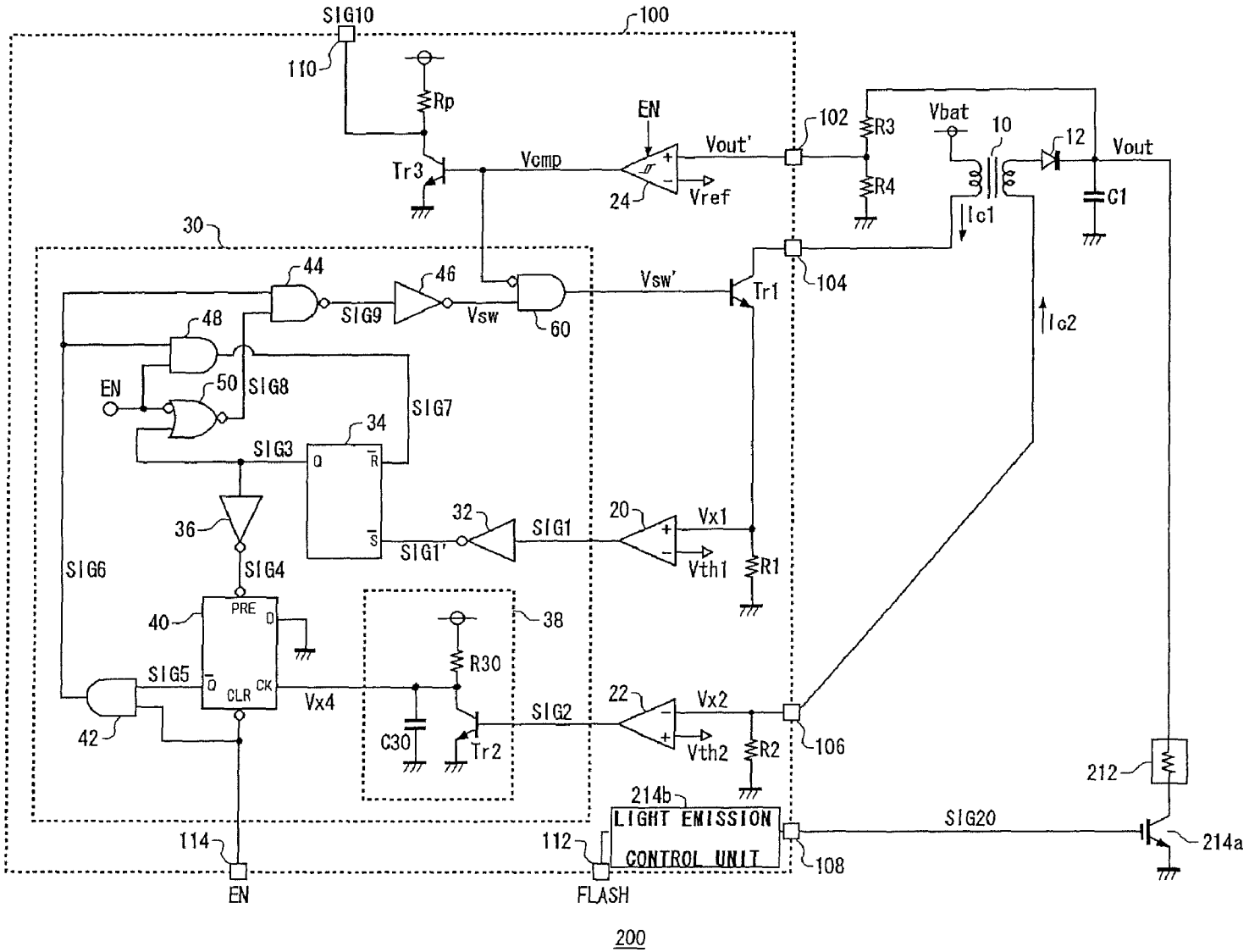
FIG. 2 is a circuit diagram which shows the configuration of the light emitting apparatus according to the embodiment.

FIG. 2 is a circuit diagram which shows a configuration of the light emitting apparatus 200 according to the present embodiment. The light emitting apparatus 200 includes a control circuit 100, a transformer 10, a rectifier diode 12, an output capacitor C1, the light emitting element 212, and an IGBT 214*a*. As necessary, in the following description, the reference numerals that denote a voltage signal, a current signal, and a resistor also represent the voltage value, the current value, and the resistance, respectively.

A combination of the control circuit 100, the transformer 10, the rectifier diode 12, and the output capacitor C1 shown in FIG. 2 corresponds to the DC/DC converter 210 shown in FIG. 1. Also, with the present embodiment, a switching transistor Tr1, the transformer 10, the rectifier diode 12, and the output capacitor C1 form a DC/DC converter output circuit. On the other hand, a combination of the IGBT 214*a* and a light emission control circuit 214*b* shown in FIG. 2 corresponds to the light emission control unit 214 shown in FIG. 1.

The battery voltage Vbat is applied to the first terminal of the primary coil of the transformer 10. The second terminal thereof is connected to a first output terminal 104 of the control circuit 100. On the other hand, the first terminal of the secondary coil of the transformer 10 is connected to the anode of the rectifier diode 12. Furthermore, the output capacitor C1 is connected between the cathode of the rectifier diode 12 and the ground terminal. The second terminal of the secondary coil of the transformer 10 is connected to a second detection terminal 106.

The control circuit 100 controls the currents of the first and second coils of the transformer 10 so as to boost the battery voltage Vbat, and supplies the voltage thus boosted to the light emitting element 212 in the form of a driving voltage.

The IGBT 214*a* is connected such that it is provided on the current path of the light emitting element 212. The gate of the IGBT 214*a* is connected to a light emission control terminal 108 of the control circuit 100. With such an arrangement, on/off control is performed for the IGBT 214*a* according to a light emission control signal SIG20 output from the control circuit 100. Upon reception of the light emission control signal SIG20 at the high level, the IGBT 214*a* is turned on, whereupon the light emitting element 212 emits light.

Next, description will be made regarding the configuration of the control circuit 100. The control circuit 100 includes the switching transistor Tr1, a switching control unit 30, a first voltage comparator 20, a first resistor R1, a second voltage comparator 22, a second resistor R2, a hysteresis comparator 24, a transistor Tr3, a pull-up resistor Rp, and a light emission control unit 214*b*. The control circuit 100 is integrally formed on a single semiconductor substrate as a functional IC.

The switching transistor Tr1 is an NPN bipolar transistor. The collector of the switching transistor Tr1 is connected to the first output terminal 104. Also, the switching transistor Tr1 may be a MOSFET.

The first resistor R1 is provided on the current path of the current that flows through the primary coil of the transformer 10 (which will be referred to as the "first current Ic1" hereafter). That is to say, the first resistor R1 is connected between the emitter of the switching transistor Tr1 and the ground terminal. When the switching transistor Tr1 is turned on, the first current Ic1 flows through the primary coil of the transformer 10, whereupon the first resistor R1 generates the voltage drop Vx1=Ic1×R1. Note that the voltage at the connection between the first resistor R1 and the switching transistor Tr1 will be referred to as the "first detection voltage Vx1" hereafter.

The first comparator 20 compares the first detection voltage Vx with a predetermined first threshold voltage Vth1. In a case that Vx1 is greater than Vth1, the first comparator 20 outputs an output signal SIG1 at the high level. On the other hand, in a case that Vx1 is smaller than Vth1, the first comparator 20 outputs an output signal SIG1 at the low level. As described above, the first detection voltage Vx1 is proportional to the first current Ic1 that flows through the primary coil of the transformer 10. Accordingly, in a case that the first current Ic1 has reached a first threshold current Ith1=Vth1/R1, the output signal SIG1 of the first voltage comparator 20 is set to the high level.

The second resistor R2 is provided on the path for the current that flows through the secondary coil of the transformer 10 (which will be referred to as the "second current Ic2" hereafter). That is to say, the second resistor R2 is provided between the second detection terminal 106 and the grounded terminal. When the second current Ic2 flows through the secondary coil of the transformer 10, the second resistor R2 generates the voltage drop Vx2=Ic2×R2. Note that the voltage at one terminal of the second resistor R2 will be referred to as "second detection voltage Vx2" hereafter.

The second voltage comparator 22 compares the second detection voltage Vx2 with a predetermined second voltage Vth2. In a case that Vth2 is greater than Vx2, the second comparator 22 outputs an output signal SIG2 at the high level. On the other hand, in a case that Vth2 is smaller than Vx2, the second comparator 22 outputs an output signal SIG2 at the low level. In other words, in a case that the second current Ic2, which flows through the secondary coil of the transformer 10, has reached a second threshold current Ith2=Vth2/R2, the output signal SIG2 of the second voltage comparator 22 is set to the high level. With the present embodiment, the second threshold voltage Vth2 is set to a negative voltage value, i.e., a voltage smaller than 0 V. As a result, the second threshold current Ith2 is set to a negative current value around 0 A.

The output voltage Vout of the DC/DC converter 210 is divided by a third resistor R3 and a fourth resistor R4. The divided voltage Vout'=Vout×R4/(R3+R4) is input to a voltage detection terminal 102 of the control circuit 100.

The non-inverting input terminal of the hysteresis comparator 24 is connected to the voltage detection terminal 102. With such an arrangement, the detection voltage Vout' is input to the non-inverting input terminal of the hysteresis comparator 24. On the other hand, a reference voltage Vref is input to the inverting input terminal of the hysteresis comparator 24. The hysteresis comparator 24 compares the detection voltage Vout' that corresponds to the output voltage Vout of the DC/DC converter with two threshold voltages (which will be referred to as "VH" and "VL" hereafter) determined according to the reference voltage Vref. In a case that the detection voltage Vout' is smaller than the lower threshold voltage VL, the hysteresis comparator 24 outputs the comparison signal Vcmp at the first level (low level). On the other hand, in a case that the detection voltage Vout' is greater than the higher threshold voltage VH, the hysteresis comparator 24 outputs the comparison signal Vcmp at the second level (high level).

The switching control unit 30 performs on/off control for the switching transistor Tr1 according to the comparison signal Vcmp output from the hysteresis comparator 24, in addition to the output signals SIG1 and SIG2 of the first voltage comparator 20 and the second voltage comparator 22.

Now, summary description will be made regarding the switching operation provided by the switching control unit 30. The switching control unit 30 performs on/off control for the switching transistor Tr1 on a rapid time scale according to the output signals SIG1 and SIG2 of the first voltage comparator 20 and the second voltage comparator 22.

In a case that the first detection voltage Vx1 exceeds the first threshold voltage Vth1, i.e., in a case that the first current Ic1 flowing through the primary coil of the transformer 10 has reached the first threshold current Ith1, the switching control unit 30 turns off the switching transistor Tr1.

On the other hand, in a case that the second detection voltage Vx2 exceeds the second threshold voltage Vth2, i.e., in a case that the second current Ic2 flowing through the secondary coil of the transformer 10 has reached the second threshold current Ith2=0 A, the switching control unit 30 turns on the switching transistor Tr1 after a delay of a predetermined period of time. With such an arrangement, the switching transistor Tr1 is alternately turned on and off according to the aforementioned control, thereby boosting the battery voltage Vbat.

On an extended time scale, the switching control unit 30 performs intermittent operations in which a charging period and a suspension period are alternately provided. Here, in the charging period, the switching transistor Tr1 is alternately turned on and off as described above. On the other hand, in the suspension period, the switching operation is suspended.

Next, detailed description will be made regarding an example of the configuration of the switching control unit 30.

The output signal SIG1 of the first voltage comparator 20 is inverted by an inverter 32. The output signal SIG1' of the inverter 32 is input to the set terminal (negative logic) of an RS flip-flop 34. The output signal SIG3 of the RS flip-flop 34 is inverted by an inverter 36. The output signal SIG4 of the inverter 36 is input to the preset terminal (negative logic) of a D flip-flop 40. Furthermore, the output signal SIG3 of the RS flip-flop 34 is input to one of the input terminals of a NOR gate 50.

A step-up instruction signal EN output from the DSP 314 is input to a step-up instruction terminal 114, which performs on/off control for the entire DC/DC converter 210. In a case that the step-up instruction signal EN is at the high level, the control circuit 100 drives the switching transistor Tr1 so as to perform the voltage step-up operation. The NOR gate 50 performs logical operation of the step-up instruction signal EN and the output signal SIG3 output from the RS flip-flop 34. The output signal SIG8 of the NOR gate 50 is input to a NAND gate 44.

The switching control unit 30 includes a delay circuit 38 for delaying the output signal SIG2 of the second voltage comparator 22. The switching transistor Tr1 is turned on according to the output of the delay circuit 38.

The delay circuit 38 includes a transistor Tr2, a resistor R30, and a capacitor C30. With regard to the transistor Tr2, the emitter is grounded, and the base is connected to the output of the second voltage comparator 22. On the other hand, the resistor R30 is provided between the collector of the transistor Tr2 and the power supply terminal. On the other hand, the capacitor C30 is provided between the collector terminal of the transistor Tr2 and the grounded terminal. With such an arrangement, in a case that the second detection voltage Vx2 becomes 0 V, the output signal of the second voltage comparator 22 is set to the low level. In this case, the transistor Tr2 is turned off, whereupon the charging of the capacitor C30 is started. The voltage Vx4 at the one terminal of the capacitor C30 increases according to the CR time constant.

The voltage Vx4 at one terminal of the capacitor C30 is input to the clock terminal of the D flip-flop 40. The data terminal of the D flip-flop 40 is grounded, i.e., is set to the low level. Furthermore, the step-up instruction signal EN is input to the clear terminal of the D flip-flop 40, which allows the control circuit 100 to be initialized each time the voltage step-up operation is started. On the other hand, the output signal SIG4 of the inverter 36 is input to the preset terminal (negative logic) of the D flip-flop 40.

In a case that the output voltage Vx4 of the delay circuit 38, which is input to the clock terminal, has been set to the high level during a period when the high-level signals are input to the preset terminal (negative logic) and the clear terminal (negative logic), the D flip-flop 40 outputs the high level signal as an inverted output signal SIG5. On the other hand, in a case that the output of the inverter 36, which is input to the preset terminal, has been switched from the high level to the low level, the D flip-flop 40 outputs the low level signal as the inverted output signal SIG5.

The inverted output signal SIG5 of the D flip-flop 40 is input to an AND gate 42. The AND gate 42 outputs the AND of the inverted output signal SIG5 of the D flip-flop 40 and the step-up instruction signal EN to the NAND gate 44. The NAND gate 44 outputs the NAND of the output of the NOR gate 50 and the output of the AND gate 42. An inverter 46 inverts the output signal SIG9 of the NAND gate 44. The output signal Vsw of the inverter 46 is input to an AND gate 60.

The output signal SIG6 of the AND gate 42 and the step-up instruction signal EN are input to an AND gate 48. The output signal SIG7 of the AND gate 48 is input to the reset terminal of the RS flip-flop 34.

The comparison signal Vcmp output from the hysteresis comparator 24 is input to the AND gate 60. The AND gate 60 outputs the AND of the inverted signal of the comparison signal Vcmp and the switching signal Vsw to the base of the switching transistor Tr1.

During a period when the comparison signal Vcmp is at the high level, the switching signal Vsw', which is the output of the AND gate 60, is set to the low level, thereby suspending the switching operation of the switching transistor Tr1. Such a period will be referred to as the "suspension period" hereafter. On the other hand, during a period when the comparison signal Vcmp is at the low level, the switching signal Vsw' exhibits the same logical value as that of the output signal Vsw of the inverter 46. Such a period will be referred to as the "charging period" hereafter. The switching control unit 30 performs intermittent operations in which the charging period and the suspension period are alternately provided. The above is the configuration of the switching control unit 30.

With regard to the transistor Tr3, the comparison signal Vcmp, which is output from the hysteresis comparator 24, is input to the base that serves as a control terminal, the collector is biased to the power supply voltage via the pull-up resistor Rp, and the emitter is grounded. Furthermore, the collector of the Tr3 is connected to a light-emission permission terminal 110. The light-emission permission terminal 110 provides the light-emission permission signal SIG10, which is the logically inverted signal of the comparison signal Vcmp.

The light emission control unit 214*b* generates the light emission control signal SIG20 according to the flash signal FLASH input to a light-emission instruction terminal 112, which controls the base voltage of the IGBT 214*a*.

Figure 3:
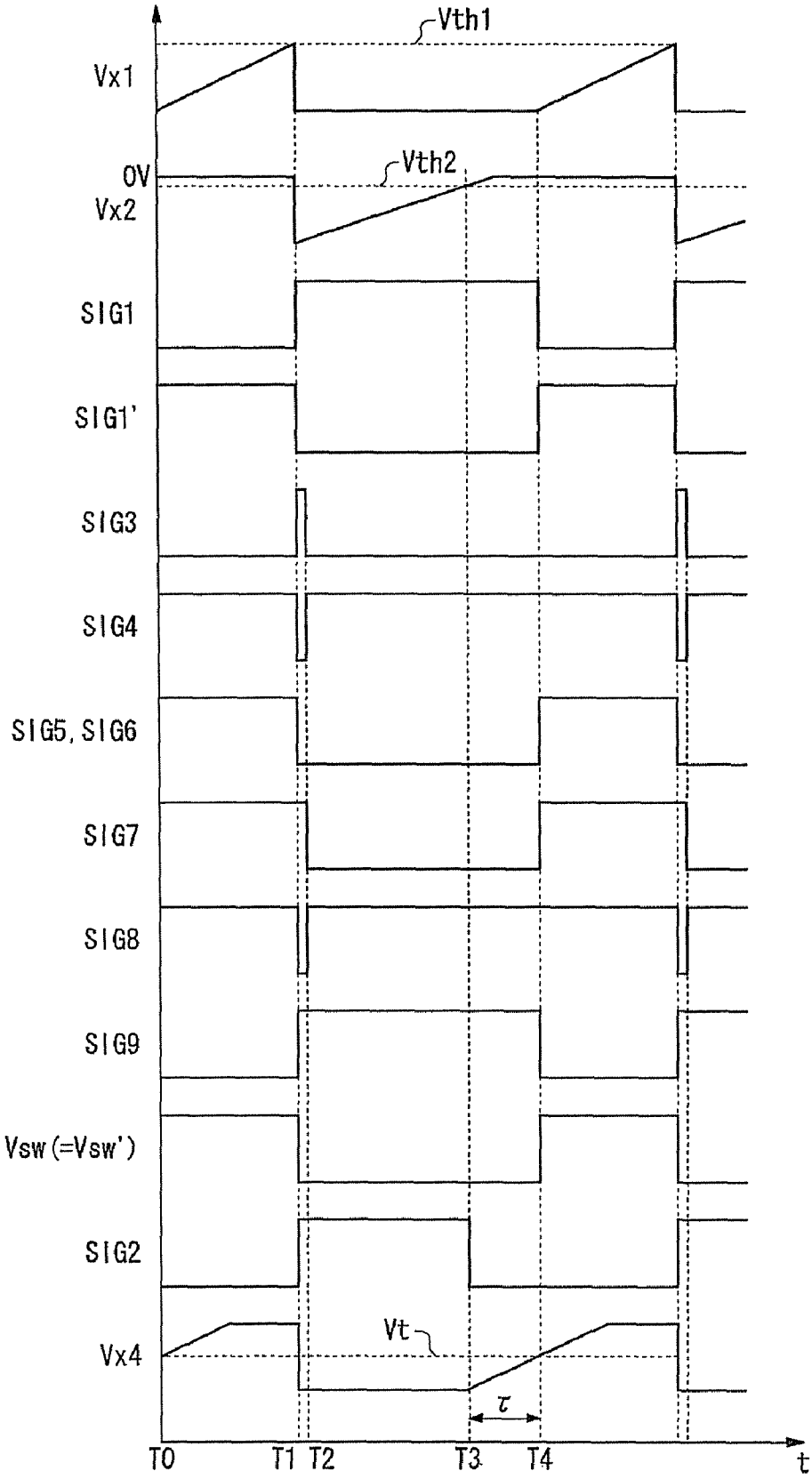
FIG. 3 is a time chart for the charging period of the DC/DC converter shown in FIG. 2.

Description will be made regarding the operation of the light emitting apparatus 200 having the above-described configuration. FIG. 3 is a time chart for the charging period of the DC/DC converter shown in FIG. 2. The signals SIG1 through SIG9 correspond the signals shown in FIG. 2. Let us say that the step-up instruction signal EN is set to the high level after the point in time T0.

With such an arrangement, the switching signal Vsw is set to the high level at the point in time T0, and accordingly, the switching transistor Tr1 is turned on. When the switching transistor Tr1 is turned on as described above, the first current Ic1 that flows through the primary coil of the transformer 10 gradually increases. As a result, the first current Ic1 comes to exceed Vth1 at the point in time T1.

In a case that Vx1 exceeds Vth1, the output signal SIG1 of the first voltage comparator 20 is switched from the low level to the high level. At the same time, the output signal SIG1' of the inverter 32 is switched from the high level to the low level. When the signal SIG1' is switched from the high level to the low level, the RS flip-flop 34 is set such that the output signal SIG3 thereof is set to the high level. In a case that the signal SIG3 has been set to the high level, the output signal SIG4 of the inverter 36 is set to the low level. Accordingly, the D flip-flop 40 is preset such that the inverted output signal SIG5 thereof is set to the low level. Now, the set-up instruction signal EN is set to the high level. Accordingly, the output signal SIG6 of the AND gate 42 exhibits the same logical value as that of the signal SIG5.

When the step-up instruction signal EN is at the high level, the NOR gate 50 serves as an inverter providing a function of inverting the output signal SIG3 of the RS flip-flop 34. Accordingly, when the output signal SIG3 of the RS flip-flop 34 has been set to the high level at the point in time T1, the output signal SIG8 of the NOR gate 50 changes from the high level to the low level. At the same time, both of the two input signals SIG6 and SIG8 of the NAND gate 44 become the low level. Accordingly, the output signal SIG9 of the NAND gate 44 is set to the high level. As a result, the switching signal Vsw (=Vsw') output from the inverter 46 is set to the low level at the point in time T1, thereby turning off the switching transistor Tr1.

When the output signal SIG6 of the AND gate 42 becomes the low level at the point in time T1, the output signal SIG7 of the AND gate 48 is set to the low level at the point in time T2 after a predetermined delay time that corresponds to several gates from the point in time T1. While there are other factors that cause the delay, description thereof will be omitted for simplification of explanation. When the output signal SIG7 of the AND gate 48 changes from the high level to the low level, the RS flip-flop 34 is reset. As a result, the output signal SIG3 of the RS flip-flop 34 is immediately returned to the low level. When the output signal SIG3 of the RS flip-flop 34 becomes the low level, the output signal SIG8 of the NOR gate 50 is switched to the high level. Furthermore, the output signal SIG4 of the inverter 36, i.e., the signal input to the preset terminal of the D flip-flop 40, is switched to the high level.

When the switching transistor Tr1 is turned off at the point in time T1, the second current Ic2 starts to flow through the secondary coil of the transformer 10. The second current Ic2 exhibits the maximum value immediately after the switching transistor Tr1 has been turned off. Subsequently, the second current Ic2 gradually decreases as the energy stored in the transformer 10 reduces. As a result, the second detection voltage Vx2 at the second resistor R2 gradually increases with the passage of time. When the second detection voltage Vx2 reaches the second threshold voltage Vth2 at the point in time T3, the output signal SIG2 of the second voltage comparator 22 is switched from the high level to the low level.

When the output signal SIG2 of the second voltage comparator 22 becomes the low level at the point in time T3, the output voltage Vx4 of the delay circuit 38 starts to increase according to the time constant. When the output voltage Vx4 of the delay circuit 38, which is input to the clock terminal of the D flip-flop 40, reaches a threshold voltage Vt at the point in time T4 after a delay of $\tau$ from the point in time T3, the inverted output signal SIG5 of the D flip-flop 40 is set to the high level. When the inverted output signal SIG5 of the D flip-flop 40 is switched to the high level, both the output signal SIG6 of the AND gate 42 and the output signal SIG7 of the AND gate 48 are set to the high level. When the output signal SIG6 of the AND gate 42 is switched to the high level, the output signal SIG9 of the NAND gate 44 is switched to the low level. On the other hand, the output signal of the inverter 46, i.e., the switching signal Vsw (=Vsw') is switched to the high level, thereby turning on the switching transistor Tr1 again.

As described above, during the charging period, the control circuit 100 according to the present embodiment detects the first current Ic1 flowing through the primary coil, and the second current Ic2 flowing through the secondary coil, of the transformer 10, and performs on/off control for the switching transistor Tr1 according to the detection results. The on/off control is performed for the switching transistor Tr1 such that the output capacitor C1 stores the charge, thereby raising the output voltage Vout.

Figure 4:
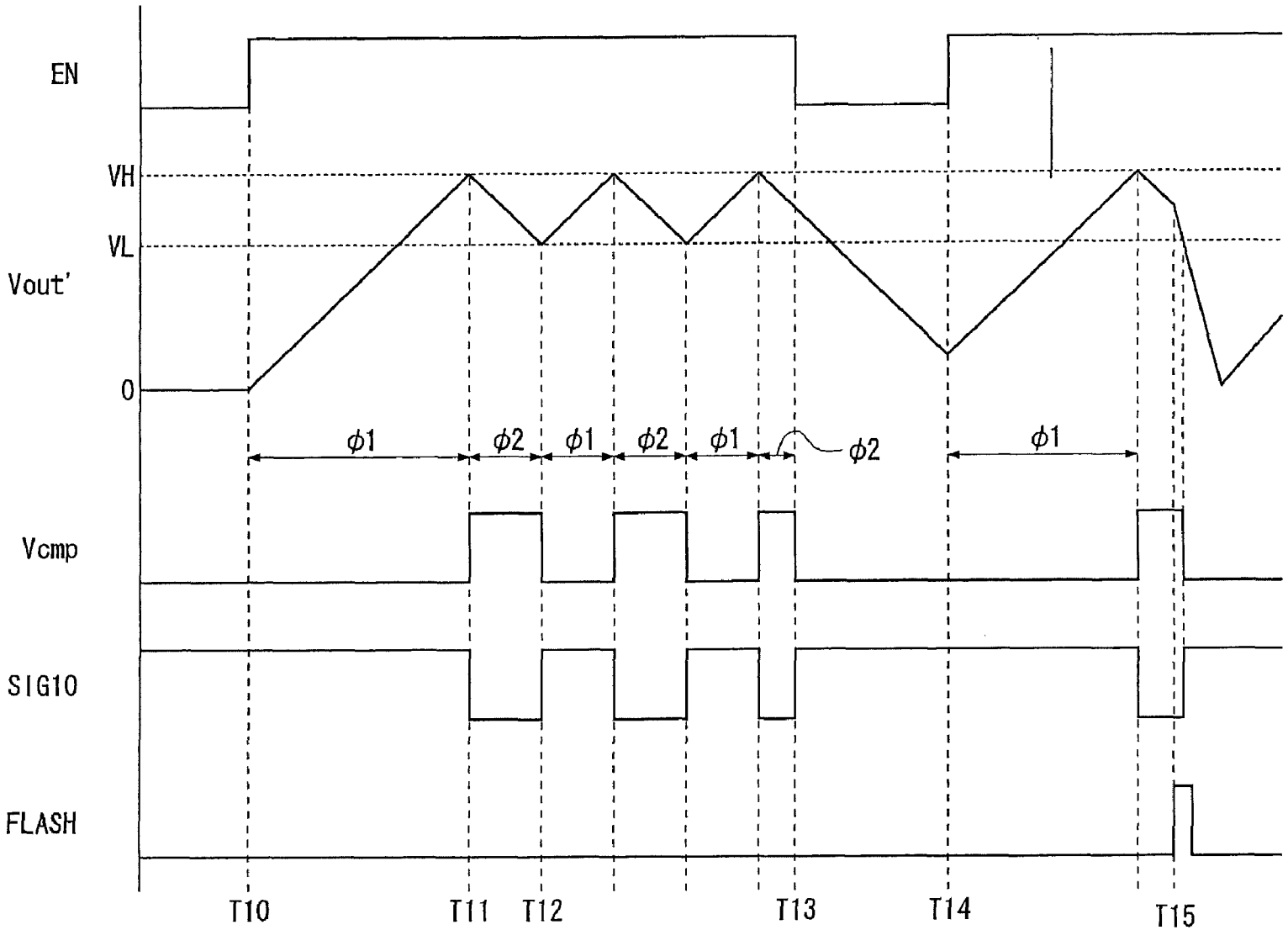
FIG. 4 is a time chart for the entire light emitting apparatus shown in FIG. 2.

FIG. 4 is a time chart for the entire light emitting apparatus 200 shown in FIG. 2. In FIG. 4, the vertical axis and the horizontal axis are expanded or reduced for simplification of explanation as appropriate. At the point in time T10, the step-up instruction signal EN is set to the high level, whereupon the control circuit 100 starts the voltage step-up operation. Here, Vout' is smaller than VH during the period from the point in time T10 up to the point in time T11, and accordingly, the comparison signal Vcmp, which is the output of the hysteresis comparator 24, is set to the low level. In this case, the voltage step-up operation is performed as described above with reference to FIG. 3. As a result, the output voltage of the DC/DC converter 210 is raised with the passage of time. When the detection voltage Vout' that corresponds to the output voltage Vout reaches the higher threshold voltage VH, the comparison signal Vcmp is set to the high level. When the comparison signal Vcmp is switched to the high level, the switching signal Vsw is set to the low level, thereby providing the suspension period $\phi$2. During the suspension period $\phi$2, the switching operation of the switching transistor Tr1 is suspended, thereby suspending the charging of the capacitor C1. Accordingly, the detection voltage Vout' decreases with the passage of time.

When the detection voltage Vout' decreases to the lower threshold voltage VL at the point in time T12, the comparison signal Vcmp is set to the low level again, thereby providing the charging period ϕ1 again. As described above, the DC/DC converter 210 repeatedly and alternately provides the charging period ϕ1 and the suspension period ϕ2, thereby maintaining a stable detection voltage Vout' within a range between the two threshold voltages VH and VL.

When the step-up instruction signal EN is switched to the low level at the point in time T13, the control circuit 100 suspends the switching operation of the switching transistor Tr1, thereby suspending the voltage step-up operation. Furthermore, the internal circuit blocks are turned off, thereby providing a low power consumption standby state. During this period, the control circuit 100 turns off all the internal circuit blocks such as the first voltage comparator 20, the second voltage comparator 22, the hysteresis comparator 24, etc.

When the step-up instruction signal EN is switched to the low level, and when the hysteresis comparator 24 is turned off, the comparison signal Vcmp is set to the low level regardless of the value of the detection voltage Vout'. Accordingly, the light-emission permission signal SIG10 is pulled up to the high level.

When the step-up instruction signal EN is switched to the high level again at the point in time T14, the DC/DC converter 21 starts the voltage step-up operation. Output of the flash signal FLASH to the light-emission control circuit 214 is only permitted in a case where the light-emission permission signal SIG10 is at the low level. For example, in FIG. 4, the flash signal FLASH is set to the high level at the point in time T15. When the flash signal FLASH is switched to the high level, the light emitting element 212 emits light. As a result, the charge stored in the output capacitor C1 is discharged, thereby reducing the detection voltage Vout'. When the detection voltage Vout' becomes smaller than the lower threshold voltage VL, the comparison signal Vcmp is set to the low level. When the comparison signal Vcmp is switched to the low level, the light-emission permission signal SIG10 is set to the high level. Accordingly, light emission is inhibited during a period up to the point in time at which the detection voltage Vout' reaches the higher threshold voltage VH again.

With the light emitting apparatus 200 according to the present embodiment, light emission is permitted during a period when the light-emission permission signal SIG10 is set to the low level, i.e., during a period in which the detection voltage Vout' has dropped from the higher threshold voltage VH to the lower threshold voltage VL. As a result, light emission is only permitted in a case that the detection voltage Vout' is higher than the threshold voltage VL. This ensures stable emission of light by the light emitting apparatus 212.

On the other hand, light emission is inhibited during a period when the light-emission permission signal SIG10 is set to the high level, i.e., during the charging period in which the detection voltage Vout' increases from the lower threshold voltage VL to the higher threshold voltage VH.

The flow of the charge stored in the output capacitor C1 through the light emitting element 212 is involved in the light emission by the light emitting element 212. Accordingly, in a case that the emitting element 212 emits light during the charging period for charging the output capacitor C1, charging and discharging of the output capacitor C1 occur at the same time. This leads to increased current consumption. On the other hand, with the light emitting apparatus 200 according to the present embodiment, light emission is permitted only during the suspension period, thereby reducing current consumption.

Furthermore, with the control circuit 100 according to the present embodiment, the hysteresis comparator for the stable provision of the output voltage Vout (detection voltage Vout') is also used for determining whether or not light emission of the light emitting element 212 is permitted. That is to say, the present embodiment offers circuitry at a reduced scale as compared with an arrangement including an additional comparator for determining whether or not light emission is permitted.

Furthermore, with the present embodiment, the comparison signal Vcmp is inverted using the transistor Tr3 and the pull-up resistor Rp, and the signal thus inverted is used as the light-emission permission signal SIG10, instead of a simple arrangement in which the comparison signal Vcmp is directly output to the DSP 314 as the light-emission permission signal SIG10. This provides the following advantage.

For the sake of low power consumption, the control circuit 100 sets the hysteresis comparator 24 to the off state during a period when the step-up instruction signal EN is set to the low level. When the hysteresis comparator 24 is turned off, such an arrangement according to the present embodiment ensures that the electric potential of the collector of the transistor Tr3, i.e., the light-emission permission signal SIG10, is pulled up to the high level. This inhibits the light emission by the light emitting element 212 during this period in a sure manner.

The above-described embodiments have been described for exemplary purposes only, and are by no means intended to be interpreted restrictively. Rather, it can be readily conceived by those skilled in this art that various modifications may be made by making various combinations of the aforementioned components or processes, which are also encompassed in the technical scope of the present invention.

Various modifications can be made regarding the circuit configuration of the switching control unit 30. Description has been made in the above embodiment regarding an arrangement in which the switching control circuit 30 includes the AND gate 60, and the switching operation of the switching transistor Tr1 is suspended according to the comparison signal Vcmp output from the comparator 24. However, the present invention is not restricted to such a circuit configuration. Rather, any logical circuit configuration may be made as long as such a logical circuit configuration allows the switching signal Vsw' to be set to the low level in order to suspend the switching operation.

Also, in the present embodiment, the settings of the high level and the low level logical values have been described for exemplary purposes only. The settings may be modified as appropriate using an inverter for inverting a signal, etc.

While description has been made in the embodiment regarding an arrangement in which the control circuit 100 is employed in the form of an integrated circuit, the present invention is not restricted to such an arrangement. For example, the switching transistor Tr1 may be employed in the form of a discrete element. Also, the first resistor R1 and the second resistor R2 may be employed in the form of chip components externally connected to the control circuit 100.

Description has been made in the embodiment regarding a self-exciting DC/DC converter. Also, the present invention may be applied to a separately-excited switching regulator having a configuration in which on/off control is performed for the switching transistor Tr1 according to the cycle voltage output from an oscillator. In this case, the hysteresis comparator 24 is also provided. With such an arrangement, in the same way as described above with regard to the embodiment, intermittent operations are performed in which the charging period and the suspension period are alternately executed, and light emission by the light emitting element 212 is permitted only during the suspension period.

While the preferred embodiments of the present invention have been described using specific terms, such description is for illustrative purposes only, and it is to be understood that changes and variations may be made without departing from the spirit or scope of the appended claims.

What is claimed is:

1. A control circuit of a DC/DC converter for supplying a driving voltage to a light emitting element, said control circuit comprising:

a voltage detection terminal which receives a detection voltage that corresponds to an output voltage of the DC/DC converter;

a hysteresis comparator which compares the detection voltage with two threshold voltages, and outputs a first-level comparison signal when the detection voltage is smaller than the lower threshold voltage, and outputs a second-level comparison signal when the detection voltage is greater than the higher threshold voltage;

a light-emission permission terminal which outputs a signal that corresponds to the comparison signal from the hysteresis comparator;

a switching control unit which controls the switching operation of a switching element included in said DC/DC converter according to the comparison signal output from said hysteresis comparator as a reference signal, and instructs the switching element of said DC/DC converter to perform switching operation during a period when the comparison signal is at the first level, and suspends the switching operation of the switching element of said DC/DC converter during a period when the comparison signal is at the second level, and a first output terminal which receives an output signal from the switching control unit;

wherein light emission of the light emitting element is inhibited during a period when the comparison signal is at the first level, and wherein light emission of the light emitting element is permitted during a period when the comparison signal is at the second level.

2. A control circuit according to claim 1, further comprising:

a first voltage comparator which compares the voltage that corresponds to the current flowing through a primary winding of a transformer with a predetermined first threshold voltage;

a second detection terminal through which a current of a secondary winding of the transformer flows; and a second voltage comparator which compares the voltage at the second detection terminal;

wherein on/off control is performed for the switching element according to the output signals of said first and second voltage comparators in a self-exciting manner.

3. A control circuit according to claim 2, further comprising:

a delay circuit which receives the output signal from the second voltage comparator, wherein the on/off control of the switching element is performed according to the output signal of the delay circuit.

4. A control circuit according to claim 1, further comprising:

a light-emission instruction terminal which receives a flash signal synchronous with a timing of the image capturing;

a light-emission control unit which receives the flash signal via the light-emission instruction terminal;

a light emission control terminal which is connected to a light emission control transistor and receives an output signal from the light-emission control unit.

5. A control circuit according to claim 4, further comprising:

a step-up instruction terminal which receives a step-up instruction signal from an external circuit, and wherein said switching control unit suspends the switching operation of the switching element, and sets internal circuit blocks to the off-state during a period when the step-up instruction signal instructs to suspend the step-up voltage operation, and wherein said switching control unit inhibits light emission of the light emitting element during a period when a potential of the light-emission permission terminal is set to the high level.

6. A control circuit of a DC/DC converter for supplying a driving voltage to a light emitting element, said control circuit comprising:

a hysteresis comparator which compares a detection voltage that corresponds to the output voltage of said DC/DC converter with two threshold voltages, and outputs a first-level comparison signal when the detection voltage is smaller than the lower threshold voltage, and outputs a second-level comparison signal when the detection voltage is greater than the higher threshold voltage; and a switching control unit which controls the switching operation of a switching element included in said DC/DC converter according to the comparison signal output from said hysteresis comparator as a reference signal, and instructs the switching element of said DC/DC converter to perform switching operation during a period when the comparison signal is at the first level, and suspends the switching operation of the switching element of said DC/DC converter during a period when the comparison signal is at the second level, wherein light emission of the light emitting element is inhibited during a period when the comparison signal is at the first level, and wherein light emission of the light emitting element is permitted during a period when the comparison signal is at the second level.

7. A control circuit according to claim 6, further comprising a transistor in which the comparison signal output from said hysteresis comparator is input to the control terminal thereof, another terminal thereof is biased to a high potential via a pull-up resistor, and the remaining terminal thereof is grounded, wherein a state of whether or not the light emission of the light emitting element is permitted, is output according to the potential at the one terminal of said transistor.

8. A control circuit according to claim 7, wherein said switching control unit receives a step-up instruction signal from an external circuit, and wherein said switching control unit suspends the switching operation of the switching element, and sets internal circuit blocks to the off-state during a period of receiving an instruction to suspend the step-up voltage operation, and wherein said switching control unit inhibits light emission of the light emitting element during a period when the one terminal of said transistor is set to the high level.

9. A control circuit according to claim 8, further comprising:

a first voltage comparator which compares the voltage that corresponds to the current flowing through the primary winding of a transformer connected externally to said control circuit with a predetermined first threshold voltage; and a second voltage comparator which compares the voltage that corresponds to the current flowing through the secondary winding of the transformer with a predetermined second threshold voltage, wherein on/off control is performed for the switching element according to the output signals of said first and second voltage comparators in a self-exciting manner.

10. A control circuit according to claim 7, further comprising:

a first voltage comparator which compares the voltage that corresponds to the current flowing through the primary winding of a transformer connected externally to said control circuit with a predetermined first threshold voltage; and a second voltage comparator which compares the voltage that corresponds to the current flowing through the secondary winding of the transformer with a predetermined second threshold voltage, wherein on/off control is performed for the switching element according to the output signals of said first and second voltage comparators in a self-exciting manner.

11. A control circuit according to claim 6, further comprising:

a first voltage comparator which compares the voltage that corresponds to the current flowing through the primary winding of a transformer connected externally to said control circuit with a predetermined first threshold voltage; and a second voltage comparator which compares the voltage that corresponds to the current flowing through the secondary winding of the transformer with a predetermined second threshold voltage, wherein on/off control is performed for the switching element according to the output signals of said first and second voltage comparators in a self-exciting manner.

12. A control circuit according to claim 6, said control circuit is provided in a form integrated on a single semiconductor substrate.

* * * * *